United States Patent [19]

Merz et al.

[11] 4,450,053

[45] May 22, 1984

[54] DEVICE FOR FEEDING ELECTROLYTIC CELLS AND METHOD OF OPERATING THE SAID DEVICE

[75] Inventors: Walter Merz, Küsnacht; Hans Friedli, Steg, both of Switzerland

[73] Assignee: Swiss Aluminium Ltd., Chippis, Switzerland

[21] Appl. No.: 177,729

[22] Filed: Aug. 13, 1980

[30] Foreign Application Priority Data

Aug. 28, 1979 [CH] Switzerland ..... 7854/79

[51] Int. Cl.[3] ..... C25C 3/14

[52] U.S. Cl. ..... 204/67; 204/245; 204/246

[58] Field of Search ..... 204/245, 246–247, 204/243 R, 244, 67; 406/6, 34, 36, 33

[56] References Cited

U.S. PATENT DOCUMENTS

| | | | |
|---|---|---|---|
| 2,989,349 | 6/1961 | Hartley | 406/34 X |
| 3,006,825 | 10/1961 | Sem | 204/245 X |
| 3,216,918 | 11/1965 | Duclaux | 204/245 |
| 3,664,935 | 5/1972 | Johnson | 204/245 X |
| 3,681,229 | 8/1972 | Lowe | 204/245 |
| 3,780,497 | 12/1973 | Muhlrad | 204/67 X |
| 3,844,446 | 10/1974 | Solt | 406/33 |
| 4,016,053 | 4/1977 | Stankovich et al. | 204/245 X |
| 4,082,364 | 4/1978 | Krambrock | 406/33 |
| 4,118,075 | 10/1978 | Lübbehusen | 406/33 |
| 4,299,683 | 11/1981 | Adorno et al. | 204/247 X |

FOREIGN PATENT DOCUMENTS

| | | | |
|---|---|---|---|
| 770304 | 3/1957 | United Kingdom | 406/33 |

*Primary Examiner*—Donald R. Valentine

*Attorney, Agent, or Firm*—Bachman and LaPointe

[57] ABSTRACT

Device and process for automatic, process-controlled feeding of electrolytic cells for producing aluminum. Besides a low degree of wear on the feed pipes, a fast and accurate feeding of fluxing agents to a particular cell is assured.

16 Claims, 7 Drawing Figures

DEVICE FOR FEEDING ELECTROLYTIC CELLS AND METHOD OF OPERATING THE SAID DEVICE

BACKGROUND OF THE INVENTION

The present invention relates to a device for automatic, process-controlled feeding of electrolytic cells for producing aluminum, having a pressurized chamber for alumina and fluxing agents, feed pipe to the cells and bunker on each cell for storing alumina. The invention relates, too, to a method of operating the said device.

In the manufacture of aluminum from aluminum oxide the latter is dissolved in a fluoride melt made up for the greater part of cryolite. The aluminum which separates out at the cathode collects under the fluoride melt on the carbon floor of the cell; the surface of this liquid aluminum acts as the cathode. Dipping into the melt from above are anodes which, in the conventional reduction process, are made of amorphous carbon. As a result of the electrolytic decomposition of the aluminum oxide, oxygen is produced at the carbon anodes, this oxygen combines with the carbon in the anodes to form $CO_2$ and CO. The electrolytic process takes place in a temperature range of approximately 940°-970° C.

The concentration of aluminum oxide decreases in the course of the process. At an $Al_2O_3$ concentration of 1-2 wt.% the so-called anode effect occurs suddenly producing an increase in voltage from 4—4.5 V to 30 V and more. It is then required that the crust must be broken open and the concentration of aluminum oxide increased by adding more alumina to the cell.

Under normal operating conditions the cell is fed with aluminum oxide regularly, even when no anode effect occurs. Also, whenever the anode effect occurs the crust must be broken open and the alumina concentration increased by the addition of more aluminum oxide, which is called servicing the cell.

For many years now servicing the cell includes breaking open the crust of solidified melt between the anodes and the side ledge of the cell, and then adding fresh aluminum oxide. This process which is still widely practiced today is finding increasing criticism because of the pollution of the air in the pot room and the air outside. In recent years therefore it has become increasingly necessary and obligatory to hood over or encapsulated the reduction cells and to treat the exhaust gases. It is however not possible to capture completely all the exhaust gases by hooding the cells if the cells are serviced in the classical manner between the anodes and the side ledge of the cells.

More recently therefore aluminum producers have been going over to servicing at the longitudinal axis of the cell. After breaking open the crust, the alumina is fed to the cell either locally and continuously according to the point feeder principle or discontinuously along the whole of the central axis of the cell. In both cases a storage bunker for alumina is provided above the cell. The same applies for the transverse cell feeding proposed recently by the applicant (U.S. Pat. No. 4,172,018).

The bunkers for storing alumina can be re-filled from a silo mounted on a pot room vehicle or cell manipulator.

In view of the large amounts of alumina consumed and the unavoidable dust put into the air by this method, attempts have been made to use pneumatic means of transport. Alumina transported in dilute flow conditions reaches transportation speeds of about 10 m/sec in such systems. With these high speeds, however, the material of the pipeline system is subject to extremely high rates of wear. In turn, the frequency changing of parts of the system results in technical and economic disadvantages. Furthermore, it has been found difficult to feed the necessary fluxing agents quickly and to the required place in a particular cell during operation of the cell.

It is therefore the principal object of the present invention to develop a device for the automatic, process controlled feeding of electrolytic cells for producing aluminum and a method of operating the said device which, while requiring a minimum of energy, the degree of wear on the raw materials employed is so low that the service life of the feed pipes equals or exceeds that of the cell. It is a further object that a fast, accurate feeding of fluxing agents to a particular cell is assured.

SUMMARY OF THE INVENTION

The foregoing objects are by way of the device of the present invention wherein (a) the cylindrical pressure chamber for alumina and fluxing agents features in the lower region first a funnel-shaped part with a large-angled opening and then a further, smaller part with a small-angled opening which induces flow in the center of the material above it, (b) the pipeline for feeding from the pressure chamber to the electrolytic cell features a feed pipe and a compressed air pipe and is such that, in order to equalize over the whole length of the pipe the amount of air entering the feed pipe, restrictions are provided in the compressed air pipe with decreasing air blocking cross sections in the direction of material feed, and the regions where air enters the feed pipe from the compressed air pipe are made of porous material, at least in the region of the restrictions, and (c) the capacity above a measuring probe in the alumina bunker corresponds to a charge of the pressure chamber.

At least parts of the round, preferably steel, feed pipe are made of porous material e.g. sintered bronze, sintered iron or sintered aluminum oxide, although the porous material can also be in the form of wire mesh. If the porous materials constitute only a small part of the pipe sidewall, they can be secured in openings by some suitable means e.g. by shrinking or gluing, and in the case of steel pipes and metallic porous materials also by soldering or brazing.

The cross section of a feed pipe can be of any desired shape, however, round cross sections have been found to be very favorable.

The compressed air pipe running parallel to the feed pipe—also of any desired shape but preferably round or rectangular—can be next to, in or around the feed pipe.

The restrictions provided in the compressed air pipe along its full length are fixed or variable constrictions which are progressively smaller in the direction of feed. As a result of these constrictions, and reductions in cross section in the compressed air pipe at uniform distances along the pipe, the amount of compressed air entering the feed pipe is equalized out along the length of the pipe. In other words the greater part of the compressed air no longer enters the feed pipe at the end where the resistance is smallest.

Fixed constrictions or restrictions can be achieved by making indentations in the walls of the compressed air pipeline or by securing blocks, fins or profiled pieces to the inner walls of the pipe. Variable restrictions on the other hand can be provided by screws or bolts which project into the compressed air pipe and can be adjusted electromagnetically or by means of an adjusting screw.

To achieve an optimum effect, the cross section of fixed and variable restrictions amounts to at least half of the cross section of the compressed air pipe.

The provision of restrictions makes sense only if the feed pipe in the region of the restrictions is made of a porous material, otherwise the desired uniform passage of air over the whole length of the pipe cannot be achieved. The distance between restrictions can, for exanmple, be 1–6 times the diameter of the feed pipe.

With respect to the method employed the solution to the problem outlines earlier is achieved by way of the present invention wherein (a) the moment the contents of the alumina bunker reach a minimum level is registered by a measuring probe and communicated to the central data processing unit;

(b) the appropriate mixture, calculated by the central data processing unit for each cell, of fresh alumina, fluoride enriched alumina previously employed as adsorption medium, fluxing agents and ground up electrolyte residues is released for charging, and such that, (c) first the lower part of the empty pressure chamber, the central flow region, is filled with fluxing agents, then the rest of the chamber is charged with alumina, and (d) the contents of the pressure chamber are transported by compressed air in a densely flowing stream through the feed pipe, which is not previously blown empty, to the alumina bunker of the cell in question.

The solution to the previously mentioned problems by way of the present invention does not represent only a version of further automation, but means that better working conditions and greater safety are achieved, and also that the air is kept clean. A system has therefore been developed which satisfies all the mentioned basic requirements for industrial production. At the same time the energy consumed in carrying out the process is kept to a minimum by an optimal arrangement of an ingenious device.

BRIEF DESCRIPTION OF THE DRAWINGS

The present invention will now be described in detail with the aid of the following drawings wherein.

DETAILED DESCRIPTION

Figure 1:
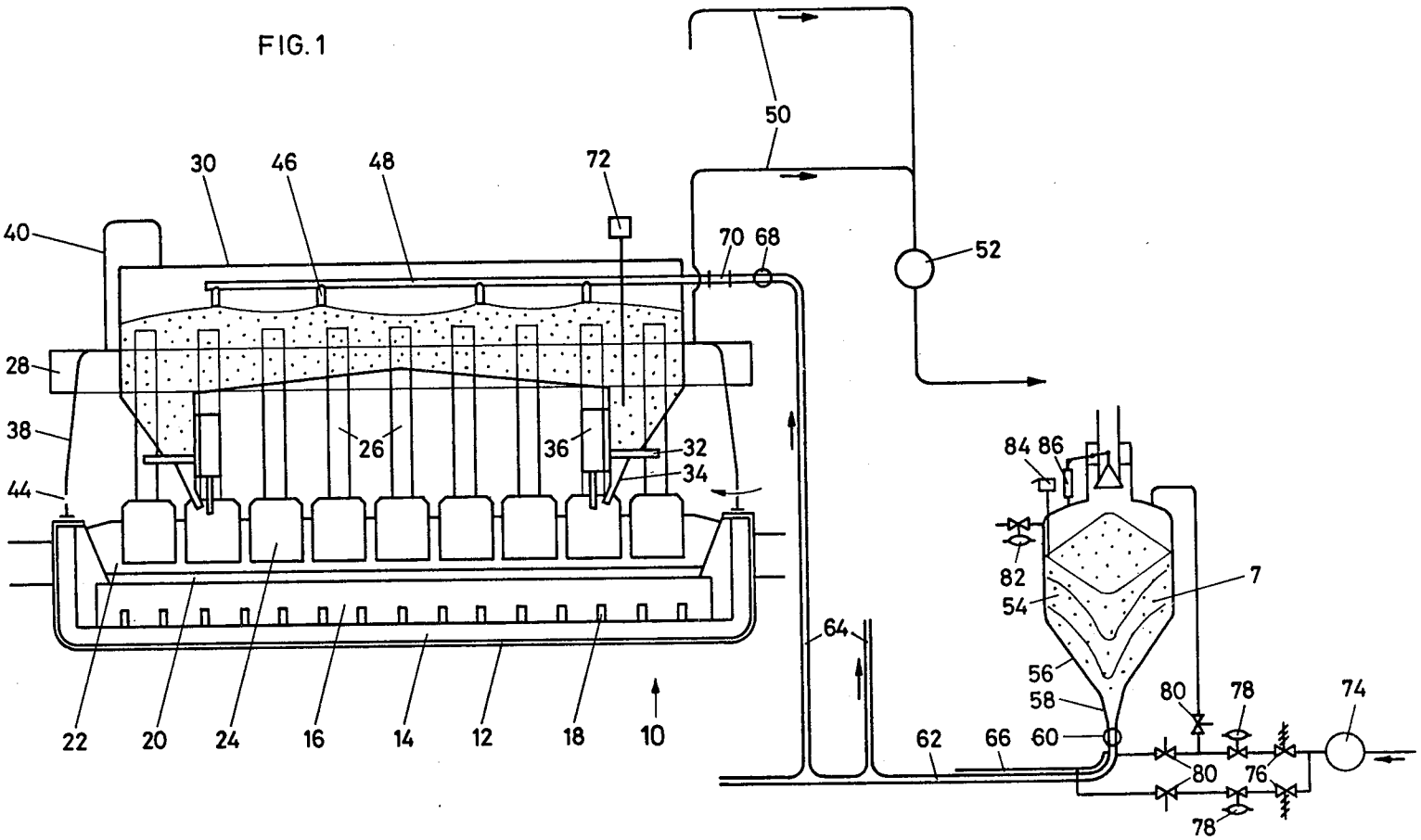
FIG. 1: Is a longitudinal section through the device.

The essential elements of the electrolytic cell 10 are the steel pot 12, the thermal insulation 14, the carbon floor 16, the cathode bars 18, the liquid aluminum 20 which lies on the carbon floor 16 and is in fact the cathode of the cell, the electrolyte 22, the carbon anodes 24, the anode rods 26 and the anode beam 28. The following materials are fed to the storage bunker 30 either alone or mixed depending on the requirements: fresh alumina, alumina enriched with fluorides, fluxing agents and ground up residual fluxing agents or electrolyte. The alumina bunker 30 is provided on both long sides with a dosing facility 32 which allows the alumina to be fed in measured amounts to the bath via pipe 34. Before the alumina is fed to the cell, as a rule the crust breaking device 36 is put into operation so that its pneumatically driven chisel for example breaks open the crust of solidified electrolyte. The bunker 30 is connected to the hooding 38 over the cell via a pipe 40. The waste gases given off during the process of electrolysis, together with secondary air entering through leaks and other imperfectly sealed parts which are represented here by an opening 44, with the compressed air from the outlets 46 in the pipe 48 and with the waste gas drawn from the alumina silo 30 via pipe 40, are sucked through pipe 50 out of the hooded pot. The whole interior of the hooding over the cell is maintained at a slight reduced pressure of a few mm of water column e.g. 10 mm by means of the suction fans 52.

The pressure chamber 54 is designed such that its under side features first a funnel-shaped part 56 which describes a large angle in cross section and then another funnel-shaped part 58 describing a smaller angle. This chamber can be closed off at the bottom by means of a facility such as a ball valve 60. The feed pipe 62 connects up via the ball valve 60 to the small-angled, funnel-shaped part 58 of the pressure chamber 54. A number of secondary feed pipes 64 branch off the main feed pipe 62 and lead to the individual cells. As shown later in FIG. 6, it is not necessary with the arrangement according to the present invention to provide any kind of valve arrangement at the branching points. A compressed air pipe 66, which, as will be explained, makes dense flow transportation of material possible, is provided parallel to the feed pipes 62 and 64. After the flow valve 68 close to the cell, a piece of the feed pipe 64 is in the form of an electrical insulator 70 to prevent short circuiting between the cells which are connected in series. The length of pipe 48 is in principle nothing other than a continuation of the feed pipe 64. Also the compressed air pipe 66 continues to the end of pipe 48. The measuring probe 72 on the bunker 30 is used to indicate when the alumina in the bunker reaches a certain minimum level.

A compressor 74 provides the compressed air which can be fed via a storage tank fitted with conventional control units, none of which is shown here, to the pressure chamber 54, the feed pipe 62 or the compressed air pipe 66 by means of pressure control valve 76, switching valve 78 and adjusting valve 80. A controlled valve 82 is provided for evacuating the pressure chamber 54.

The upper limit to which the chamber 54 is to be filled is determined by the limit switch 84. A pneumatic valve control 86 allows the charging of the pressure chamber to be regulated accurately.

FIG. 1 shows that the loosely charged material in the full pressure chamber 54 is conical in shape at the top. During the emptying of the chamber 54, the material in the upper and middle part of the container flows faster in the middle than at the edges—as has been indicated in the drawing. In the bottom part 58 flow is strongest at the centre.

Figure 2:
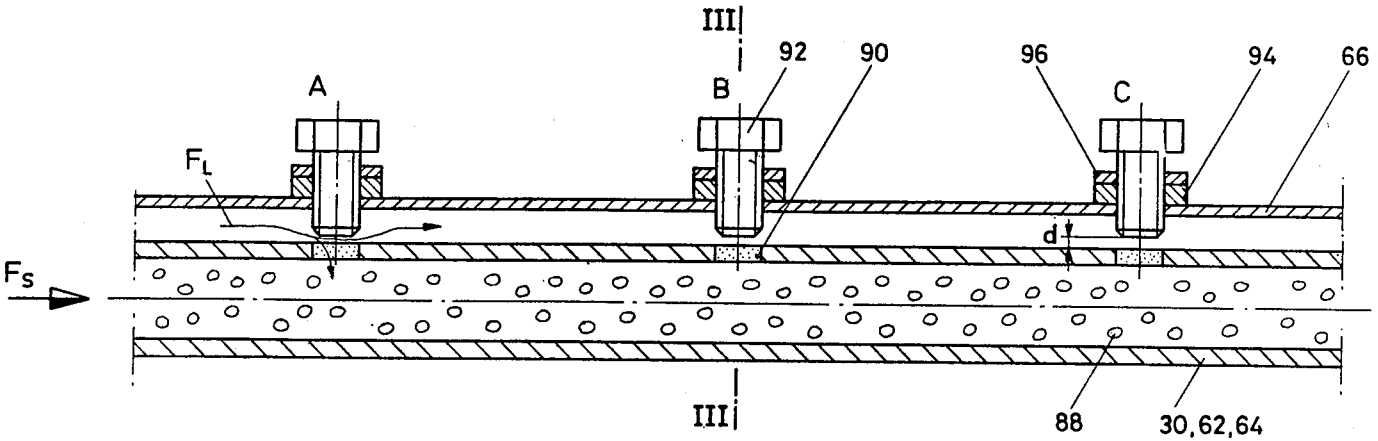
FIG. 2: Is a longitudinal section through part of the feed pipe system with adjustable screws as variable restrictions.

FIG. 2 shows a section through a straight length of the feed pipe system according to the invention. A steel pipe 30, 62, 64, which is ring-shaped in cross section and in which the powdery or granular material 88 is transported, has an inner diameter of ca. 50–100 mm and a wall thickness of approximately 3 mm. A compressed air pipe 66, which is rectangular in cross section, is welded onto the feed pipe 30, 62, 64. Circular openings in which porous discs 90 have been soldered or brazed are provided in the upper part of the feed pipe wall. Above this porous material is an adjustable screw 92 of approximately the same diameter. The lower face of this screw preferably matches the surface of the porous material i.e. has a horizontal surface. This face can however also be hemispherical, cup-shaped or the like. As the wall of the compressed air pipe 66 is too thin to take a thread, the female thread 94 is welded onto the pipe 66. A nut 96 serves to fix the adjustable screw at the desired setting.

The adjustable screws have the following functions:

(a) To regulate the amount of air entering the feed pipe;

(b) to regulate the amount of air flowing through the compressed air pipe.

Figure 3:
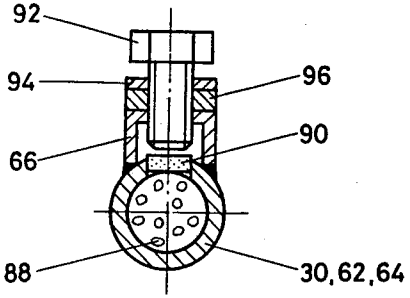
FIG. 3: Is a section along III—III in FIG. 2.

In the present case, as can be seen from FIG. 3, the dimensions of the remaining opening in the compressed air pipe and those of the part of the adjustable screw projecting into the pipe are of the same order of magnitude.

The distance d of the adjustable screw from the porous material in the feed pipe is set as a function of the following parameters:

the kind of material being transported, the length of the feed pipe, the porosity of the sintered bronze 90.

If the compressed air $F_L$ is introduced into pipe 66 in the direction of the arrow, then the resistance in the feed pipe 30, 62, 64 is smallest at the adjustable screw C i.e. most air enters there. At A on the other hand the resistance in the feed pipe is relatively large and only a small amount of air enters there. This has the effect that the material right of C is pushed forwards and on the left is pushed along after it in the direction of the arrow $F_S$. This packet-like feeding can be observed very well in a model of the device according to the invention in which the feed pipe is made of glass.

In contrast to the adjustable restrictions shown in FIGS. 2 and 3, the restriction in FIG. 3 is of the permanent, non-variable type. A profiled piece 98 is secured permanently to the upper part of the wall in the compressed air pipe 66 above the porous material 90 which is soldered or brazed into an opening in wall of the steel feed pipe 30, 62, 64. This fixed, non-variable restriction in the form of an inverse T has the effect of forcing some of the compressed air $F_L$ to flow through the gap between the porous material 90 and the profiled piece 98. The resistance is increased to a greater or lesser extent depending on the size of the distance d so that approximately the same amount of air, in terms of weight, enters the feed pipe from the compressed air pipe through all the discs 90 of porous material spaced out along the feed pipe.

Figure 4:
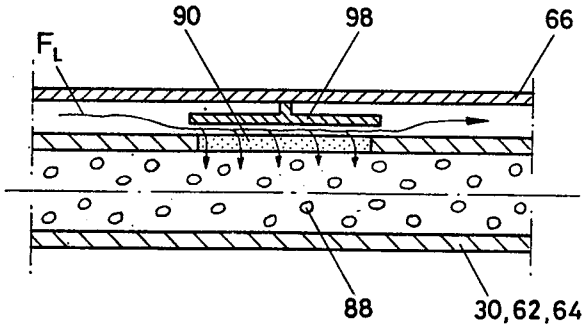
FIG. 4: Is a longitudinal section through a profiled piece which acts as a restriction.

In all the arrangements according to FIGS. 2–4 the distance d increases in the direction of material transport. The compressed air pipe is shown much larger than is the case in practice. In reality its cross-sectional dimensions can be 20 mm wide and 16 mm high for a feed pipe of 75 mm diameter.

Figure 5:
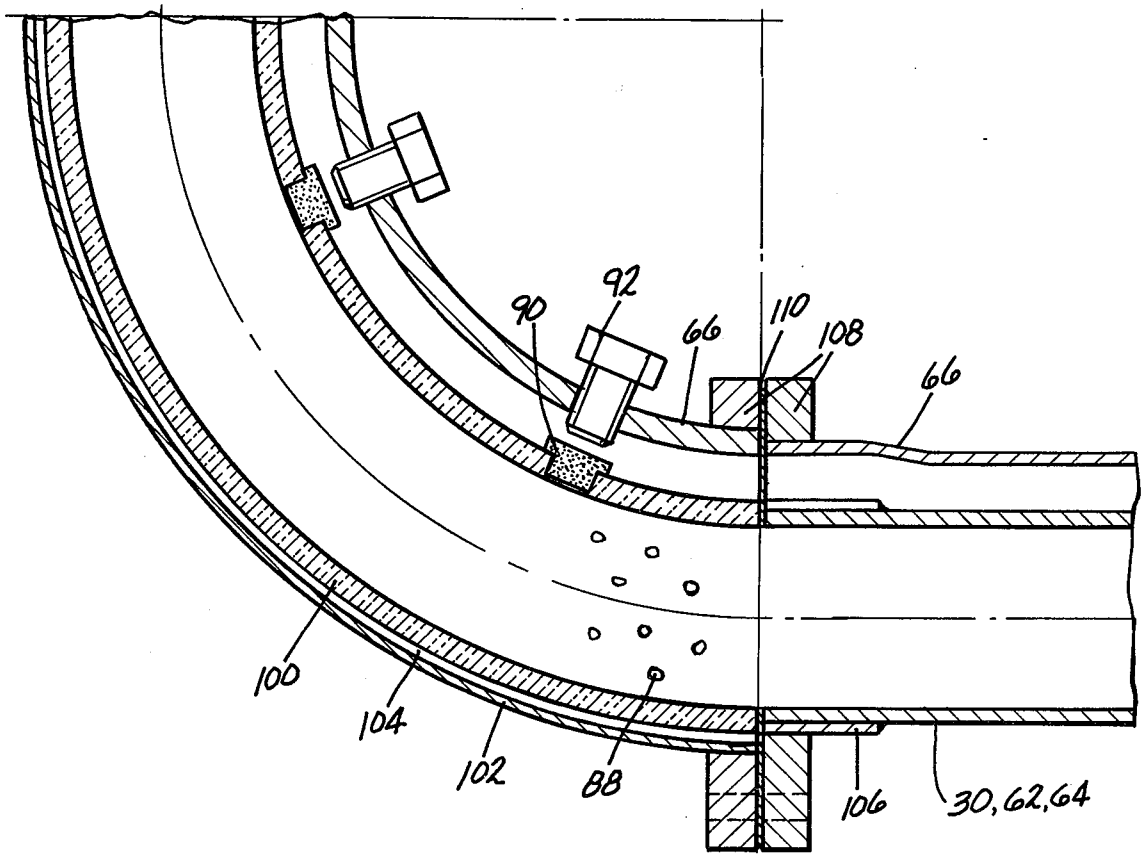
FIG. 5: Is a longitudinal section through a curved piece of the feed pipe system.

FIG. 5 shows a curved piece of a feed pipe system and its junction with a straight part. Even under relatively slow dense flow conditions, the material of the curved piece is subject to a relatively high degree of wear. According to a special version of the present invention therefore a more wear resistant insert e.g. of sintered aluminum oxide is employed for the inner wall of the feed pipe in this curved piece. Discs 90 of porous material are also provided in this ceramic part 100. The shock sensitive insert 100 is embedded in a protective sleeve 102. The ring-shaped gap 104 between the wear resistant insert 100 and the protective sleeve 102 is preferably filled with a foamed material. A strengthening ring 106 is fitted to the end of the feed pipe 30, 62, 64 to provide a smooth transition to the insert 100 which has a larger wall thickness. The straight and curved pipes are bolted together by means of flanges 108 with a flat gasket or washer 110 between them.

Figure 6:
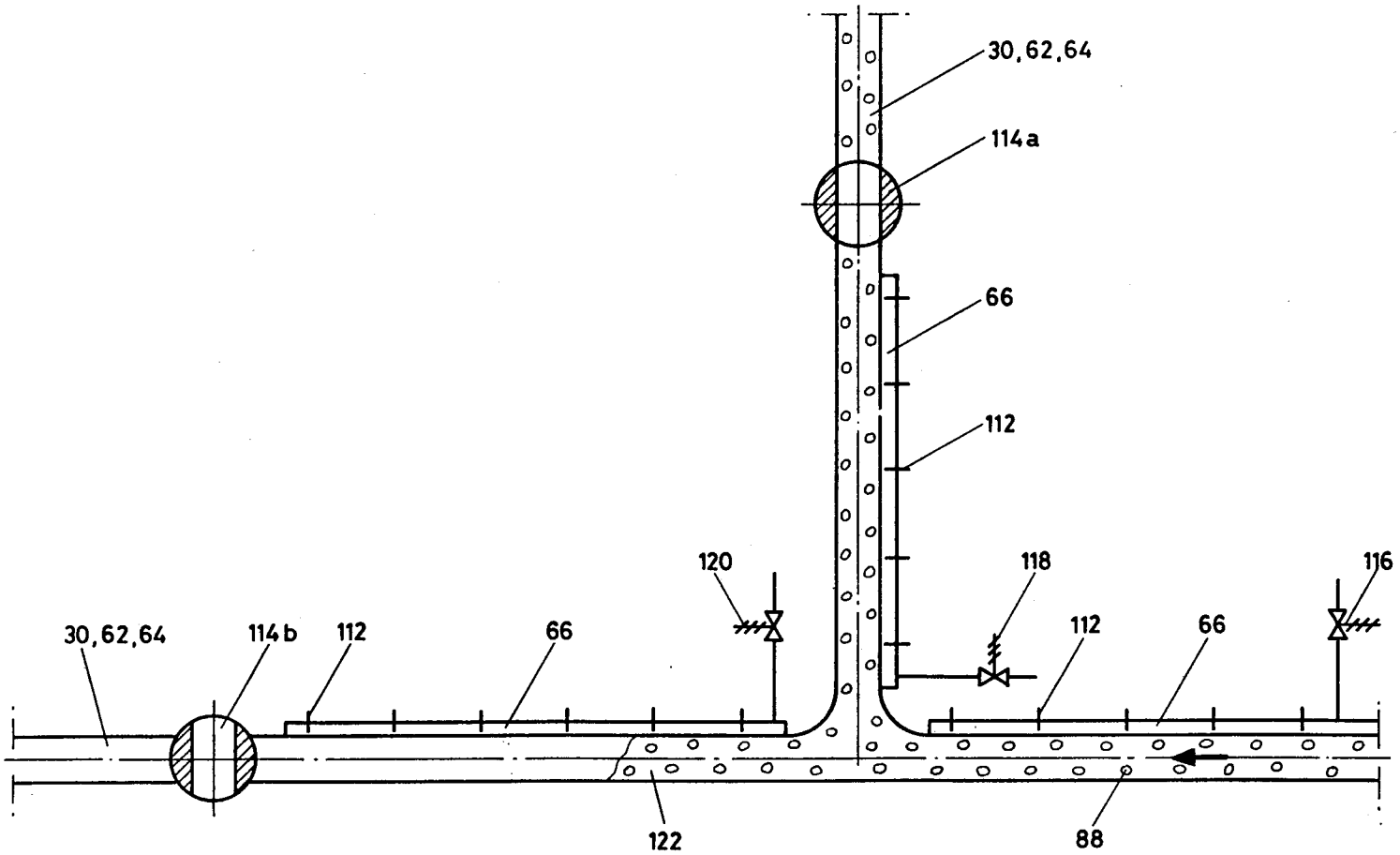
FIG. 6: Is a branch in the feed pipe system.

FIG. 6 shows a branch in the feed pipe system; this shows that no switch or three-way tap is necessary. In the present case the ball valve **114*a* is open and ball valve 114*b* closed. When the magnetic valves 116 and 118 are open, the compressed air entering the feed pipe 30, 62, 64 from compressed air channels 66 which are fitted with restrictions 112, causes the material to be conveyed through the open ball valve 114*a*** in a densely flowing stream.

When the magnetic valve 120 closes off the compressed air pipe 66, the material in the pipe is transported only a short distance along the pipe past the branching point and forms a plug 122 there. If this plug of material is to be removed, then the magnetic valve 120 and the ball valve **114*b*** must be opened. The compressed air flowing in to the feed pipe then sets the material in motion in a densely flowing stream.

Figure 7:
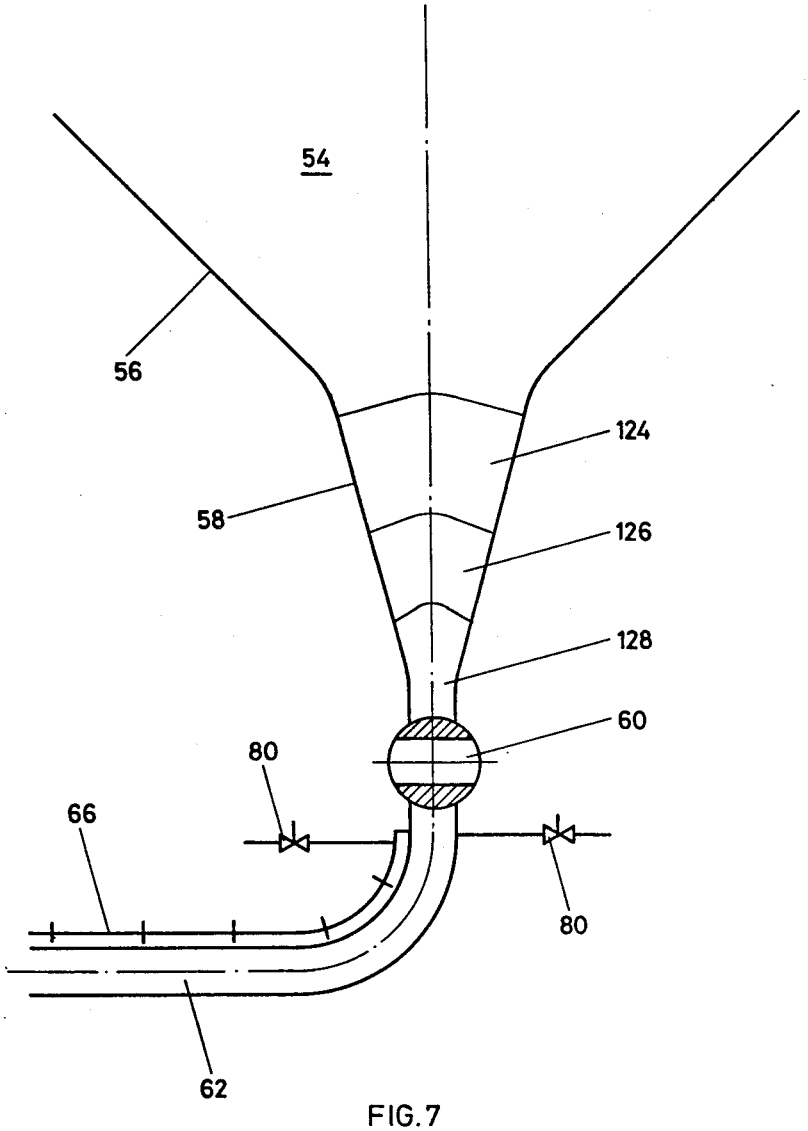
FIG. 7: Is the lower region of the pressure chamber.

FIG. 7 shows the lower part of the pressure chamber 54 in detail. The funnel-shaped part 56 with the wide-angled opening is, like the rest of the container in the cylindrical part, full of alumina. Only the lower part of the pressure chamber, the part 58 with the small-angled opening, is filled with cryolite 124, ground up electrolyte 126 and aluminum fluoride 128. This amount of fluxing agents, which can also be charged to the pressure chamber 54 as a mixture instead of in layers, constitutes however only a few percent of the whole charge e.g. 0.5–5%. If the ball valve 60 is opened to charge a cell, then this arrangement ensures that the fluxing agents flowing from the centre will in any case be fed in their full amount to the cell in question.

It is understood of course that, as well as alumina as described above, any kind of loose, fine granular material can be transported using the device and method according to the invention.

What is claimed is:

1. A device for the automatic controlled feeding of an alumina mixture to an electrolytic cell used in the production of aluminum comprising:

at least one electrolytic cell;

an alumina mixture storage bunker positioned above said at least one electrolytic cell, said alumina mixture storage bunker being provided with means for feeding an alumina mixture to said at least one electrolytic cell;

a pressure chamber, said pressure chamber being provided with means for charging said pressure chamber with the alumina mixtures;

a feed system for transporting the alumina mixture from said pressure chamber to said alumina mixture storage bunker by means of compressed air, said feed system comprising an elongated material feed pipe, a plurality of compressed air inlet means provided over the entire length of said elongated material feed pipe, and means associated with said plurality of compressed air inlet means for equalizing the amount of compressed air entering said elongated material feed pipe over the entire length thereof; and sensing means in said alumina mixture storage bunker for sensing the level of the alumina mixture for charging said pressure chamber in response to said sensed condition and feeding the alumina mixture from said pressure chamber to said alumina mixture storage bunker.

2. A device according to claim 1 wherein said pressure chamber is substantially cylindrical and is provided with a first upper funnel-shaped part and a second lower funnel-shaped part, said first funnel-shaped part having an engled opening greater than said second funnel-shaped part.

3. A device according to claim 1 wherein said means associated with said plurality of compressed air inlet means comprises a plurality of air flow restrictions provided in a compressed air pipe.

4. A device according to claim 3 wherein the size of said air flow restrictions increases in the direction of material flow.

5. A device according to claim 4 wherein said plurality of compressed air inlet means comprises a porous material.

6. A device according to claim 5 including means for varying the size of said air flow restrictions.

7. A device according to claim 6 wherein said means for varying the size of said air flow restrictions comprises adjustable bolt means projecting into said compressed air pipe.

8. A device according to claim 5 wherein said air flow restrictions comprise fins attached to the walls of said compressed air pipe.

9. A device according to claim 3 wherein said compressed air pipe and said material feed pipe share a common wall.

10. A device according to claim 5 wherein said air flow restrictions face the surface of said porous material inlet means and are equal in area.

11. A device according to claim 5 wherein said porous material is made of sintered bronze, sintered iron or sintered aluminum oxide.

12. A device according to claim 4 wherein the constriction of the flow path for the air due to said air flow restrictions constitutes at least half of the cross section of said compressed air pipe.

13. A device according to claim 5 wherein said porous material is in the form of wire mesh.

14. A device according to claim 4 wherein the distance between said air flow restrictions is between 1 to 6 times the diameter of said material feed pipe.

15. A device according to claim 1 wherein said material feed pipe comprises a curved portion and a straight portion, said curved portion comprising a shock sensitive ceramic material.

16. A process for automatically feeding an alumina mixture to electrolytic cells comprising:

providing at least one electrolytic cell;

providing an alumina mixture storage bunker over said cell;

providing said alumina mixture storage bunker with means for feeding the alumina mixture to said at least one electrolytic cell;

providing a pressure chamber upstream of and in communication with said alumina mixture storage bunker by means of a material feed pipe;

sensing the level of the alumina mixture in said alumina mixture storage bunker;

charging said pressure chamber with the alumina mixture in response to a minimum sensed level in said alumina mixture storage bunker;

transporting the alumina mixture from said pressure chamber to said alumina mixture storage bunker by means of compressed air through said material feed pipe; and feeding the alumina mixture from said alumina storage bunker to said at least one electrolytic cell.

* * * * *

UNITED STATES PATENT AND TRADEMARK OFFICE

CERTIFICATE OF CORRECTION

PATENT NO. : 4,450,053

DATED : May 22, 1984

INVENTOR(S) : Walter Merz and Hans Friedli

It is certified that error appears in the above–identified patent and that said Letters Patent are hereby corrected as shown below:

Column 7, claim 2, line 17, change "engled" to --angled--.

Signed and Sealed this

*Twenty-third* Day of *October 1984*

[SEAL]

*Attest:*

GERALD J. MOSSINGHOFF

*Attesting Officer*

*Commissioner of Patents and Trademarks*